US012259218B2

(12) United States Patent
Zheng

(10) Patent No.: US 12,259,218 B2
(45) Date of Patent: Mar. 25, 2025

(54) HOLDING FIXTURE ASSEMBLY FOR QUICK WEAPON-MOUNTED LIGHT DISCONNECTION AND INSTALLATION

(71) Applicant: SIRIUSTAC TECHNOLOGY CO., LTD, Shenzhen (CN)

(72) Inventor: Chuanxue Zheng, Shenzhen (CN)

(73) Assignee: SIRIUSTAC TECHNOLOGY CO., LTD., Shenzhen (CN)

( * ) Notice: Subject to any disclaimer, the term of this patent is extended or adjusted under 35 U.S.C. 154(b) by 430 days.

(21) Appl. No.: 17/747,112

(22) Filed: May 18, 2022

(65) Prior Publication Data

US 2023/0258430 A1 Aug. 17, 2023

(30) Foreign Application Priority Data

Feb. 15, 2022 (CN) ..... 202210138073.1

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41G 11/00; F41G 11/001; F41G 11/002; F41G 11/003; F41G 11/004; F41G 1/00; F41G 1/02; F41G 1/06; F41G 1/16; F41G 1/22; F41G 1/28; F41G 1/32; F41G 1/34; F41G 1/35; F41G 1/38; F41G 1/387; F41G 1/40; F41G 1/41; F16B 2/12; F16B 2/18
See application file for complete search history.

(56) References Cited

U.S. PATENT DOCUMENTS 2,005,952 A * 6/1935 Mossberg ..... F41G 1/26 42/137
4,905,396 A * 3/1990 Bechtel ..... F41G 11/003 42/127
5,941,489 A * 8/1999 Fanelli ..... F41G 1/16 42/114

(Continued)

FOREIGN PATENT DOCUMENTS

DE 29511823 U1 * 11/1995
EP 3553457 A1 * 10/2019 ..... F41G 11/003

(Continued)

*Primary Examiner* — Jonathan P Masinick
(74) *Attorney, Agent, or Firm* — Ming Jiang; OPENPTO US LLC

(57) ABSTRACT

A holding fixture assembly for quick weapon-mounted light disconnection and installation comprises a main body holding piece and a rotation shaft, the rotation shaft is installed in the main body holding piece and is rotatable, at least one sliding slot is provided in the main body holding piece, and at least one axial plane is provided in the rotation shaft. In the present invention, without using any auxiliary tools, with only hands, lights and sights can be dismantled from or installed on weapons very quickly. When to install the lights and sights, it is only necessary to push the positioning sliding blocks on devices such as lights and sights in the sliding slots in the main body holding piece and the lights can be fixed; when to dismantle devices such as lights and sights, turn the knob with hand unlocking can be done without using any auxiliary tools.

5 Claims, 3 Drawing Sheets

(56) References Cited

U.S. PATENT DOCUMENTS

| | | | | |
|---|---|---|---|---|
| 7,367,152 | B2 * | 5/2008 | Samson | F41G 1/00 42/148 |
| 8,448,374 | B2 * | 5/2013 | Samson | F41G 11/003 42/138 |
| 9,506,721 | B2 * | 11/2016 | Cheng | F41G 1/34 |
| 9,671,198 | B2 * | 6/2017 | Bartoszewicz | F41G 11/003 |
| 9,733,046 | B1 * | 8/2017 | Bozek | F41G 1/17 |
| 10,001,344 | B1 * | 6/2018 | ALford | F41G 11/003 |
| 10,024,628 | B2 * | 7/2018 | Toner | F41G 1/16 |
| 10,024,632 | B1 * | 7/2018 | Oglesby | F41G 11/003 |
| 10,060,702 | B2 * | 8/2018 | Crispin | F41G 1/387 |
| 10,066,903 | B2 * | 9/2018 | Crispin | F41G 11/003 |
| 10,288,378 | B2 * | 5/2019 | Minor | F41G 1/545 |
| 10,634,456 | B1 * | 4/2020 | Fischer | F41G 11/003 |
| 10,788,292 | B2 * | 9/2020 | Alldredge | F41G 11/003 |
| 10,837,737 | B1 * | 11/2020 | Wright | F41G 1/08 |
| 11,067,365 | B2 * | 7/2021 | Roberson | F41G 1/16 |
| 11,874,078 | B2 * | 1/2024 | Roe | F41A 21/325 |
| 11,982,511 | B2 * | 5/2024 | Melville | F41G 11/003 |
| 2007/0025101 | A1 * | 2/2007 | Lawless | F41A 9/61 362/396 |
| 2011/0047855 | A1 * | 3/2011 | Wong | F41G 11/003 42/124 |
| 2011/0283590 | A1 * | 11/2011 | Chiang | F41G 11/003 42/124 |
| 2013/0111799 | A1 * | 5/2013 | Lee | F41G 11/001 42/106 |

FOREIGN PATENT DOCUMENTS

| | | | | |
|---|---|---|---|---|
| WO | WO-2014197380 | A1 * | 12/2014 | F41A 21/32 |
| WO | WO-2020244218 | A1 * | 12/2020 | F41G 1/065 |

* cited by examiner

HOLDING FIXTURE ASSEMBLY FOR QUICK WEAPON-MOUNTED LIGHT DISCONNECTION AND INSTALLATION

TECHNICAL FIELD

The present invention belongs to the technical field of mobile lighting and gun holding fixtures, especially a holding fixture assembly for quick weapon-mounted light disconnection and installation.

BACKGROUND TECHNOLOGY

Currently, when devices such as lights and telescopic sights are mounted on guns, usually some fixing structures are used to fix the same, however, at present it is usually necessary to employ auxiliary tools such as screwdrivers and spanners to install and disassemble such fixing structures, a deficiency of this method is the necessity to use the auxiliary tools, which is troublesome, and makes it inconvenient to disassemble and install the lights and sights, and it is not possible to disconnect manually the lights and the sights from the guns without tools.

SUMMARY OF THE INVENTION

A purpose of the present invention is to provide a holding fixture assembly for quick weapon-mounted light disconnection and installation, targeting to address the problem raised in the background technology.

To realize the foregoing purpose, the technical solution adopted in the present invention is:

A holding fixture assembly for quick weapon-mounted light disconnection and installation, comprising a main body holding piece and a rotation shaft, wherein the rotation shaft is installed in the main body holding piece and is rotatable, at least one sliding slot is provided on the main body holding piece, and at least one axial plane is provided on the rotation shaft.

A sliding slot provided at a top portion of the main body holding piece is a first sliding slot, a second sliding slot is provided at a side of the main body holding piece and the second sliding slot is extending along the same direction as the first sliding slot, and both the first sliding slot and the second sliding slot are used to install at least one light and/or at least one sight.

Specifically, front portions of both the first sliding slot and the second sliding slot are open, rear portions thereof are closed, and openings are provided in the first sliding slot and the second sliding slot, elastic pieces configured to cushion shaking after installation of the at least one light and/or the at least one sight and eject the at least one light and/or the at least one sight when unlocking are provided in the openings.

Specifically, the rotation shaft passes the first sliding slot and the second sliding slot in the main body holding piece, the rotation shaft comprises a first axial plane at a position of the first sliding slot, the rotation shaft further comprises a second axial plane at a position of the second sliding slot, a head portion of the rotation shaft is configured to be cylindrical, and an elastic piece is installed on the head portion of the rotation shaft. An end of the elastic piece is fixed on the rotation shaft, and another end thereof is fixed on the main body holding piece for resetting the rotation shaft after rotation.

Specifically, at least one movable holding block is detachably installed at a side of the main body holding piece, the rotation shaft passes the main body holding piece, is installed on the at least one movable holding block and is rotatable, and a knob is provided at the head portion of the rotation shaft so as to turn the rotation shaft.

A first holding piece is provided at a side of the main body holding piece, a second holding piece corresponding to the first holding piece is provided on the movable holding block and the first holding piece and the second holding piece are configured to fix the holding fixture assembly on weapons;

At least one attachment can be installed in the first sliding slot and/or the second sliding slot via at least one positioning sliding block and the at least one attachment can slide against the first sliding slot and/or the second sliding slot, the at least one positioning sliding block is installed on the at least one attachment, wherein the at least one attachment comprises at least one laser, at least one light and/or at least one sight. Beneficial effects of the present invention: with the holding fixture assembly for quick weapon-mounted light disconnection and installation provided in the present invention, it is possible to detach or fix devices such as lights and/or sights from or on the weapons with hands without using any auxiliary tools, which makes it convenient and fast to use the weapons. When installing devices such as lights and/or sights, it is only necessary to push the positioning sliding blocks in the devices such as lights and/or sights into the sliding slots in the main body holding piece, so that the lights can be fixed; and when it is necessary to detach the devices such as lights and/or sights, just turn the knob with hand, the lights and/or sights can be unlocked without using any external auxiliary tools, and operation thereof is convenient and fast.

1: main body holding piece; 11: first sliding slot; 12: second sliding slot; 13: first holding piece; 14: elastic pillar; 15: opening; 16: opening for shaft; 2: rotation shaft; 21: elastic piece; 22: first axial plane; 23: second axial plane; 24: knob; 25: first screw; 3: movable holding block; 31: second screw; 32: second holding piece; 4: holding piece; and 41: positioning sliding block.

EMBODIMENTS

In order to facilitate understanding of the present invention, the present invention will be further described hereinafter with reference to the related drawings. The preferred embodiments of the invention are shown in the accompanying drawings. However, the present invention may be embodied in many different forms and is not limited to the embodiments described herein. Rather, these embodiments are provided so that a thorough and complete understanding of the present disclosure is provided.

Hereinafter technical solutions of the present invention will be further described in detail in conjunction with some embodiments.

As shown in FIGS. 1-6, the present invention provides a holding fixture assembly for quick weapon-mounted light disconnection and installation, comprising a main body holding piece 1 and a rotation shaft 2, the rotation shaft 2 is installed in the main body holding piece 1 and the rotation shaft 2 is rotatable, at least one sliding slot is provided on the main body holding piece 1 and at least one axial plane is provided on the rotation shaft 2.

Figure 1:
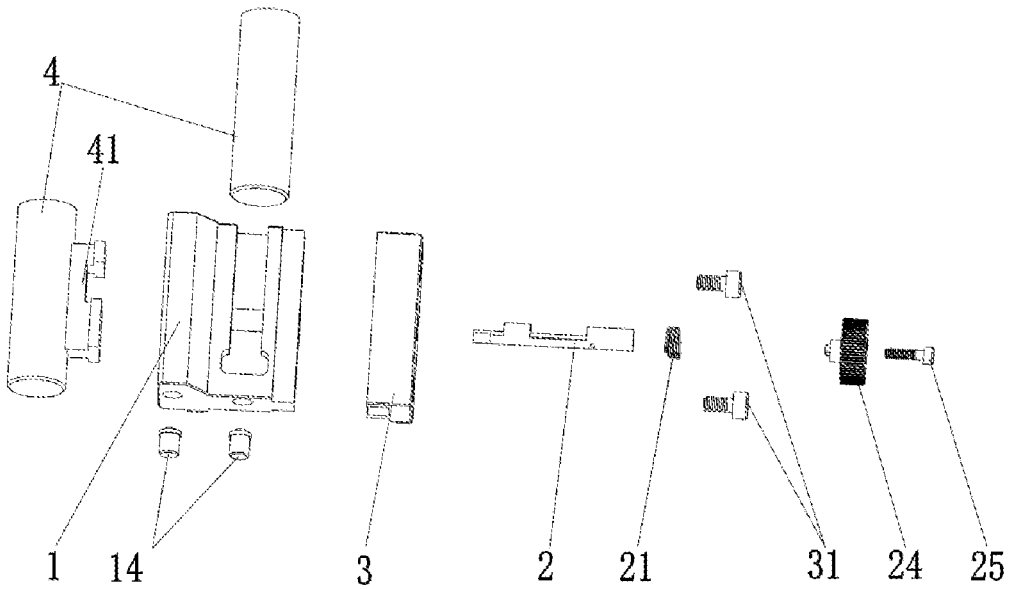
FIG. 1 is an exploded view showing the holding fixture assembly for quick weapon-mounted light disconnection and installation provided in an embodiment of the present invention.
Figure 2:
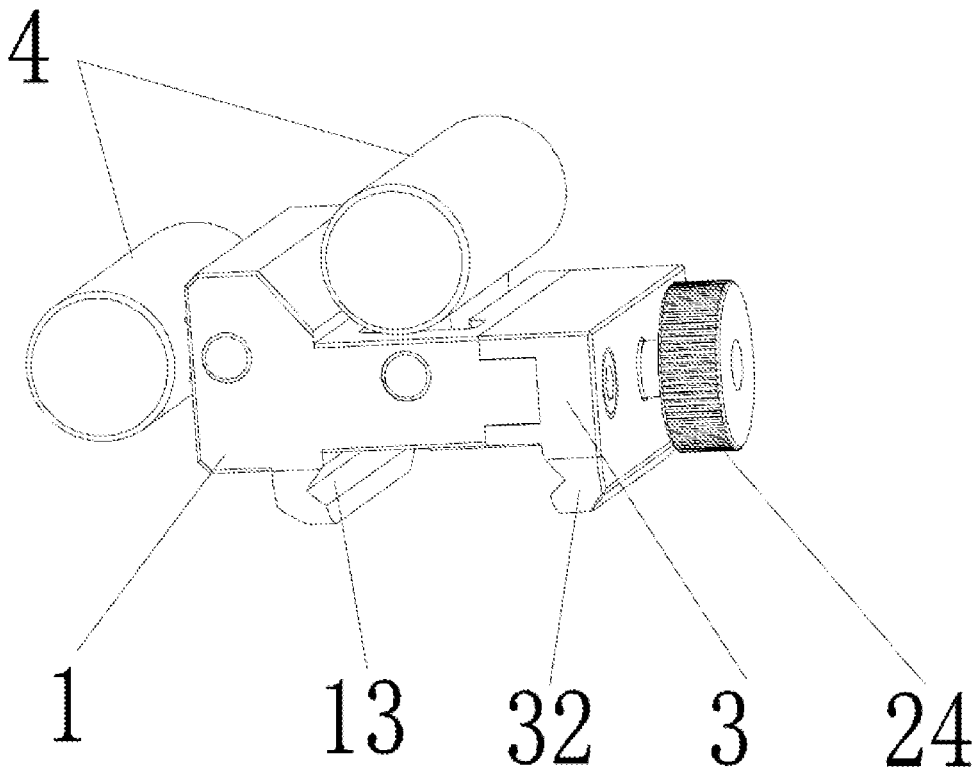
FIG. 2 is a rear view showing entire structures of the holding fixture assembly for quick weapon-mounted light disconnection and installation provided in an embodiment of the present invention.
Figure 3:
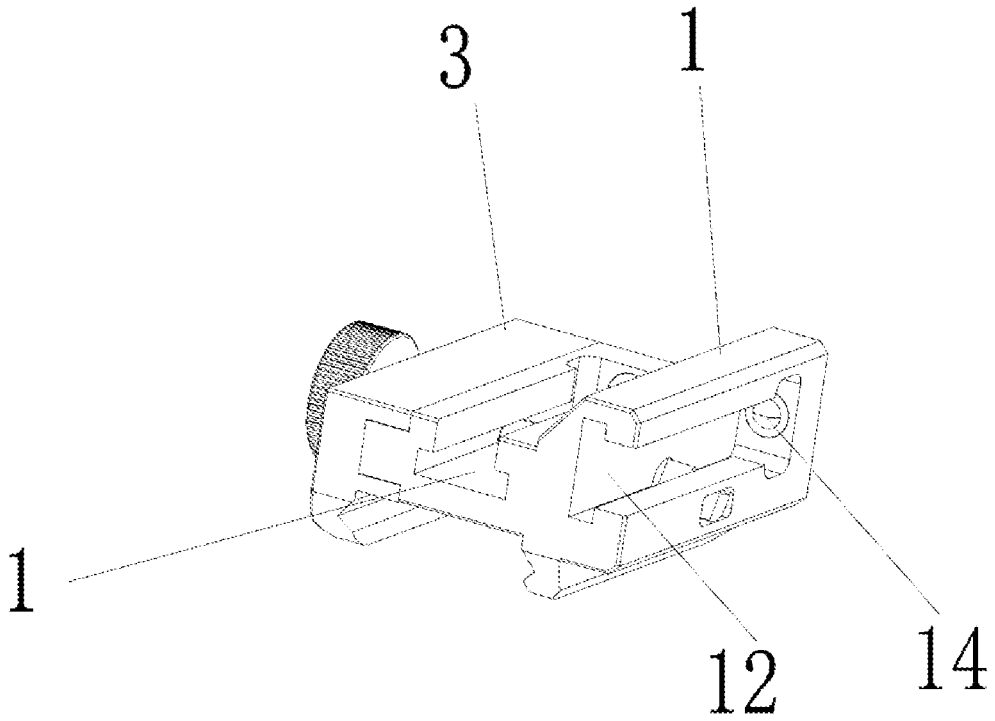
FIG. 3 is a front view showing overall structures of the holding fixture assembly for quick weapon-mounted light disconnection and installation provided in an embodiment of the present invention.

As shown in FIG. 3, a sliding slot provided at a top portion of the main body holding piece 1 is a first sliding slot 11, a second sliding slot 12 is provided at a side of the main body holding piece 1, wherein both the first sliding slot 11 and the second sliding slot 12 are configured for installation of at least one light and/or at least one sight.

Further, front portions of both the first sliding slot 11 and the second sliding slot 12 are open, rear portions thereof are closed and openings 15 are provided therein, elastic pillars 14 are installed in the openings 15, the elastic pillars 14 are made of elastic materials, and configured to damp shaking after installing at least one attachment 4, and eject positioning sliding blocks 41 after unlocking.

Further, a movable holding block 3 is detachably installed at a side of the main body holding piece 1, a first holding piece 13 and a second holding piece 32 corresponding to the first holding piece are installed on the main body holding piece 1 and configured to fix the fixture assembly according to the present invention on the weapons, the rotation shaft 2 passes the movable holding block 3, the first sliding slot 11 and the second sliding slot 12 and is installed in the opening for shaft 16, a first axial plane 22 is provided on the rotation shaft at the first sliding slot, a second axial plane 23 is provided on the rotation shaft 2 at the second sliding slot 12, a head portion of the rotation shaft 2 is configured to be a shape of a circular column and an elastic piece 21 is fixed on the head portion of the rotation shaft 2. An end of the elastic piece 21 is fixed on the rotation shaft, another end thereof is fixed on the main body holding piece 1, the elastic piece 21 provides a radial force for the rotation shaft 2, and is configured to resetting the rotation shaft 2.

Preferably, the movable holding block 3 is fixed on the main body holding piece 1 via a first screw 25, a knob 24 is fixed on the head portion of the rotation shaft 2 via a second screw 31, and with the knob 24 the rotation shaft 2 can be turned.

Figure 4:
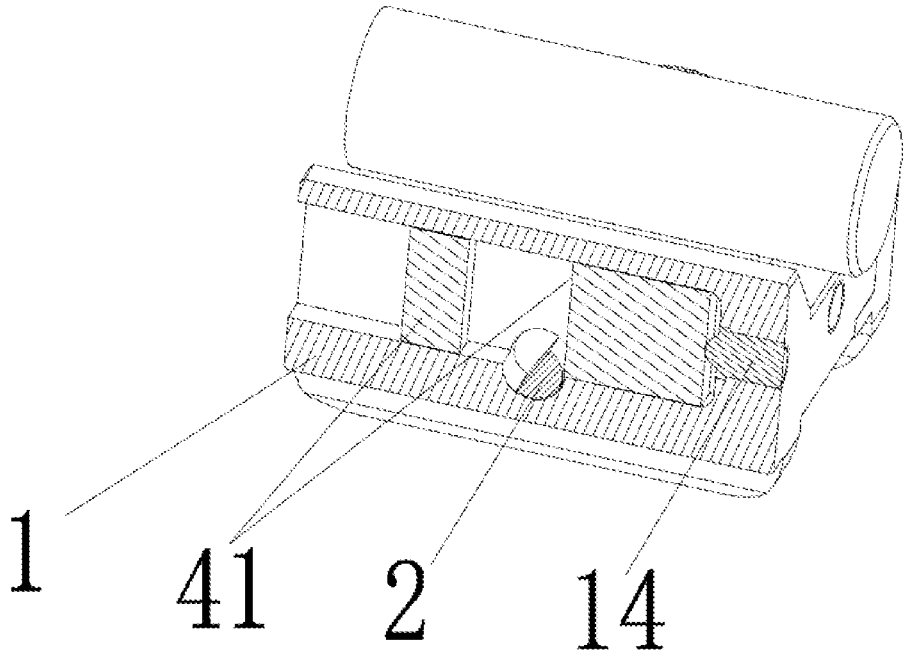
FIG. 4 is a sectional view showing a third sliding slot in an embodiment of the present invention.
Figure 5:
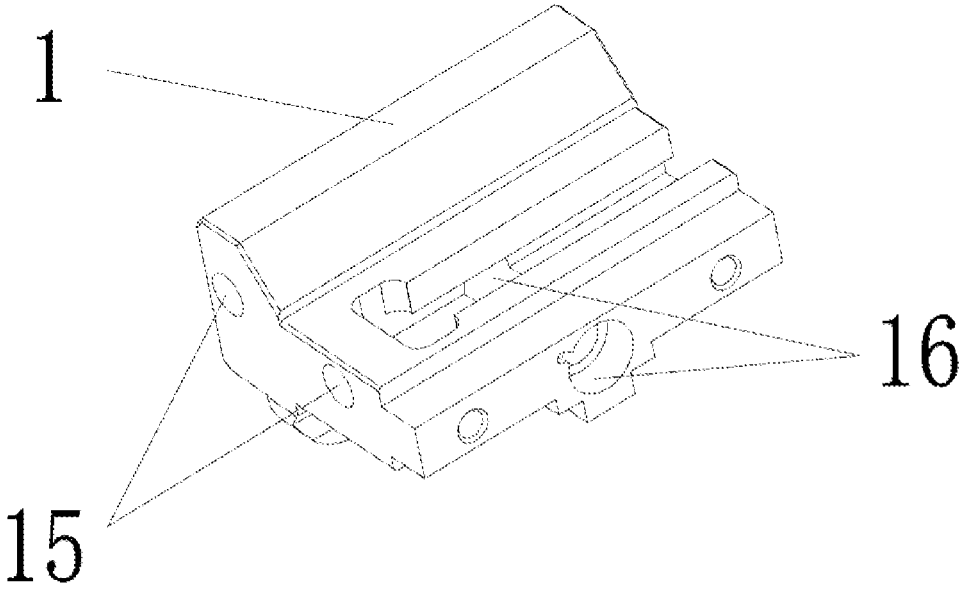
FIG. 5 is a structural diagram showing the main body holding piece provided in an embodiment of the present invention.
Figure 6:
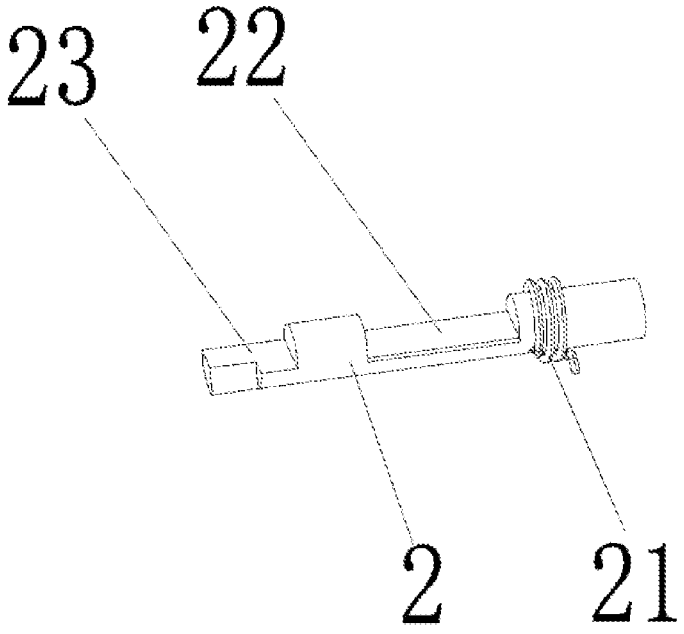
FIG. 6 is a structural diagram showing the rotation shaft provided in an embodiment of the present invention.

The at least one attachment 4 is installed in the first sliding slot 11 and the second sliding slot 12 by the positioning sliding block 41, the positioning sliding block 41 is fixed on the at least one attachment 4, and the at least one attachment 4 comprises but is not limited to at least one laser, at least one light and at least one sight. During use, install the first holding piece 13 and the second holding piece 32 on a guiding rail of a gun, push the positioning sliding blocks 41 on the at least one attachment 41 into the first sliding slot 11 or the second sliding slot 12, as shown in FIG. 4, when the positioning sliding blocks 41 have not contacted the rotation shaft 2, there is an included angle of a certain degree between the axial plane of the rotation shaft 2 and a plane of the sliding slots, when pushing the positioning sliding block 41, the axial plane of the rotation shaft 2 is forced to be horizontal with the plane of the sliding slot, the positioning sliding blocks 41 enter the rotation shaft 2 and the elastic piece 14, push the at least one attachment 4 forcefully, the elastic piece 14 is compressed by the positioning sliding blocks 41, the rotation shaft 2 resumes to a predetermined angle subject to the radial force of the elastic piece 21, release the at least one attachment 4, and the positioning sliding blocks 41 are stopped by the rotation shaft 2 and fixed. When to dismantle the at least one attachment 4, turn with the knob 24 the axial plane of the rotation shaft 2 to be the same plane as the plane of the sliding slot, the positioning sliding blocks 41 are released by the rotation shaft 2 and ejected by the elastic piece 14 so that the at least one attachment 4 is removed.

To sum up, with the holding fixture assembly for quick weapon-mounted light disconnection and installation provided in the present invention, it is possible to detach or fix devices such as lights and/or sights from or on the weapons with hands without using any auxiliary tools, which makes it convenient and fast to use the weapons. When installing devices such as lights and/or sights, it is only necessary to push the positioning sliding blocks in the devices such as lights and/or sights into the sliding slots in the main body holding piece 1, so that the lights can be fixed; and when it is necessary to detach the devices such as lights and/or sights, just turn the knob 24 with hand, the lights and/or sights can be unlocked, without using any external auxiliary tools, and operation thereof is convenient and fast.

It should be noted that when an element is described as being "fixed to" another element, it can be directly on the other element or intervening elements may also be present. When an element is referred to as being "connected" to another element, it can be directly connected to the other element or intervening elements may also be present. In contrast, when an element is referred to as being "directly on" another element, there are no intervening elements present. The terms "vertical", "horizontal", "left", "right" and similar expressions used herein are for illustrative purposes only and are not intended to be the only embodiment, terms "lower end", "left side", "right side", "front end", "rear end" and similar expressions show positional relationships with reference to the drawings.

Unless otherwise defined, all technical and scientific terms used herein have the same meaning as commonly understood by one of ordinary skill in the art to which this invention belongs. The terms used herein in the description of the present invention are for the purpose of describing specific embodiments only, and are not intended to limit the present invention. As used herein, the term "and/or" includes any and all combinations of one or more of the associated listed items.

The above embodiments are only used to illustrate the present invention, but not to limit the present invention. Those of ordinary skill in the art can also make various changes and modifications without departing from the spirit and scope of the present invention. Therefore, all equivalent technical solutions also belong to the scope of the present invention, and the patent protection scope of the present invention should be defined by the claims.

The invention claimed is:

1. A holding fixture assembly for quick weapon-mounted light disconnection and installation, comprising a main body holding piece and a rotation shaft, wherein the rotation shaft is installed in the main body holding piece and is rotatable, at least one sliding slot is provided on the main body holding piece, and at least one axial plane is provided on the rotation shaft;

wherein a sliding slot provided at a top portion of the main body holding piece is a first sliding slot, a second sliding slot is provided at a side of the main body holding piece and the second sliding slot is extending along the same direction as the first sliding slot;

wherein the rotation shaft passes the first sliding slot and the second sliding slot in the main body holding piece, the rotation shaft comprises a first axial plane at a position of the first sliding slot, the rotation shaft further comprises a second axial plane at a position of the second sliding slot.

2. The holding fixture assembly for quick weapon-mounted light disconnection and installation according to claim 1, wherein front portions of both the first sliding slot and the second sliding slot are open, rear portions thereof are closed, and openings are provided in the first sliding slot and the second sliding slot, elastic pieces are provided in the openings.

3. The holding fixture assembly for quick weapon-mounted light disconnection and installation according to claim 2, wherein a head portion of the rotation shaft is configured to be cylindrical, and an elastic piece is installed on the head portion of the rotation shaft.

4. The holding fixture assembly for quick weapon-mounted light disconnection and installation according to claim 3, wherein at least one movable holding block is detachably installed at a side of the main body holding piece, the rotation shaft passes the main body holding piece, is installed on the at least one movable holding block and is rotatable, and a knob is provided at the head portion of the rotation shaft.

5. The holding fixture assembly for quick weapon-mounted light disconnection and installation according to claim 4, wherein a first holding piece is provided at a side of the main body holding piece, and a second holding piece corresponding to the first holding piece is provided on the movable holding block.

* * * * *